US010257895B1

(12) United States Patent
Battaglia

(10) Patent No.: US 10,257,895 B1
(45) Date of Patent: Apr. 9, 2019

(54) SYSTEM AND METHOD FOR OPERATING SEGMENTS OF A LIGHTING SYSTEM

(71) Applicant: Phoseon Technology, Inc., Hillsboro, OR (US)

(72) Inventor: Salvatore T. Battaglia, Vancouver, WA (US)

(73) Assignee: Phoseon Technology, Inc., Hillsboro, OR (US)

( * ) Notice: Subject to any disclaimer, the term of this patent is extended or adjusted under 35 U.S.C. 154(b) by 0 days.

(21) Appl. No.: 15/725,096

(22) Filed: Oct. 4, 2017

(51) Int. Cl.
*H05B 33/08* (2006.01)
*F21V 5/00* (2018.01)
*F21V 29/60* (2015.01)

(52) U.S. Cl.
CPC ..... *H05B 33/0845* (2013.01); *H05B 33/0857* (2013.01); *F21V 5/004* (2013.01); *F21V 29/60* (2015.01); *H05B 33/0815* (2013.01); *H05B 33/0827* (2013.01)

(58) Field of Classification Search
CPC ..... H05B 33/0845; H05B 33/0815; H05B 33/0809; H05B 37/02; H05B 37/0227
See application file for complete search history.

(56) References Cited

U.S. PATENT DOCUMENTS

2010/0123403 A1* 5/2010 Reed ..... H05B 33/0815 315/193
2016/0150607 A1* 5/2016 Kim ..... H05B 33/0815 315/210
2016/0205735 A1* 7/2016 Heimes ..... H05B 33/0812 315/77
2016/0366731 A1 12/2016 Palfreyman et al.

FOREIGN PATENT DOCUMENTS

JP 2014089888 A 5/2014
JP 2017084461 A 5/2017
KR 20150108668 A 9/2015
KR 101582450 B1 1/2016

OTHER PUBLICATIONS

ISA Korean Intellectual Property Office, International Search Report and Written Opinion Issued in Application No. PCT/US2018/043501, dated Oct. 30, 2018, WIPO, 9 pages.

* cited by examiner

*Primary Examiner* — Dedei K Hammond
*Assistant Examiner* — Raymond R Chai
(74) *Attorney, Agent, or Firm* — McCoy Russell LLP

(57) ABSTRACT

Methods and systems are provided for operating a lighting array that is comprised of one or more lighting segments. In one example, the lighting segments may be comprised of light emitting diodes that are electrically coupled in series. The lighting segments may be controlled responsive to output of a potentiometer and the lighting segments may be controlled responsive to positions of circuit boards in an enclosure.

18 Claims, 8 Drawing Sheets

350

| Module | SEG_DIR | SEG_CTL_IN | SEG_CTL |
|---|---|---|---|
| Left | 0 | 1 | 1 |
| Center | 1 | 1 | 0 |
| Right | 1 | 0 | 1 |

SYSTEM AND METHOD FOR OPERATING SEGMENTS OF A LIGHTING SYSTEM

BACKGROUND/SUMMARY

A lighting system may include one or more arrays of light emitting elements. The arrays may include lighting elements that are electrically coupled in series and parallel. During some conditions, it may be desirable to have all arrays in the lighting system activated simultaneously. Further, it may be desirable to adjust the intensity of light provided via the lighting system. One example of when it may be desirable to activate all arrays of a lighting system is when the lighting system is supplying light to cure a large work piece. However, if the lighting system is being applied to cure a smaller work piece, activating all arrays in the lighting system may consume more energy than is desired. Further, activating all arrays in the lighting system may expose some areas of the work piece to levels of illumination that may be greater than is desired. While it may be possible to control an array of lights in a lighting system via a microcontroller, the microcontroller may increase system cost and complexity.

The inventor herein has recognized the above-mentioned disadvantages and has developed a lighting system, comprising: a plurality of lighting segment driver circuits, each of the plurality of lighting segment driver circuits electrically coupled to a lighting segment; and a plurality of circuit boards including the plurality of lighting segment driver circuits, each of the plurality of circuit boards identical to the other of the plurality of circuit boards, each of the plurality of circuit boards including comparator circuits that are in electrical communication with the plurality of lighting segment driver circuits.

By providing a single circuit board that provides different functions responsive to the location of the single circuit board in an enclosure, it may be possible to selectively activate and deactivate lighting segments to reduce energy consumption without activating and deactivating the lighting segments via outputs of a microcontroller that includes executable instructions. In one example, lighting segments may be selectively activated and deactivated responsive to a plurality of voltage levels that are compared to a command voltage. The plurality of voltage levels may be determined via selecting values of resistors that form a voltage dividing network. In addition, output of two comparators may be reversed to control a direction and order of voltages that are compared to the command voltage so that the single board design may control a direction in which lighting segments may be activated and deactivated.

The present description may provide several advantages. In particular, the approach may reduce system cost via eliminating programming of a controller. Further, the approach utilizes a single circuit board design that allows the single circuit board design to provide different functionality depending on location of the circuit board in an enclosure. In addition, the approach may reduce system power consumption when operations on a work piece may be performed with less than all lighting segments in a lighting array operating.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
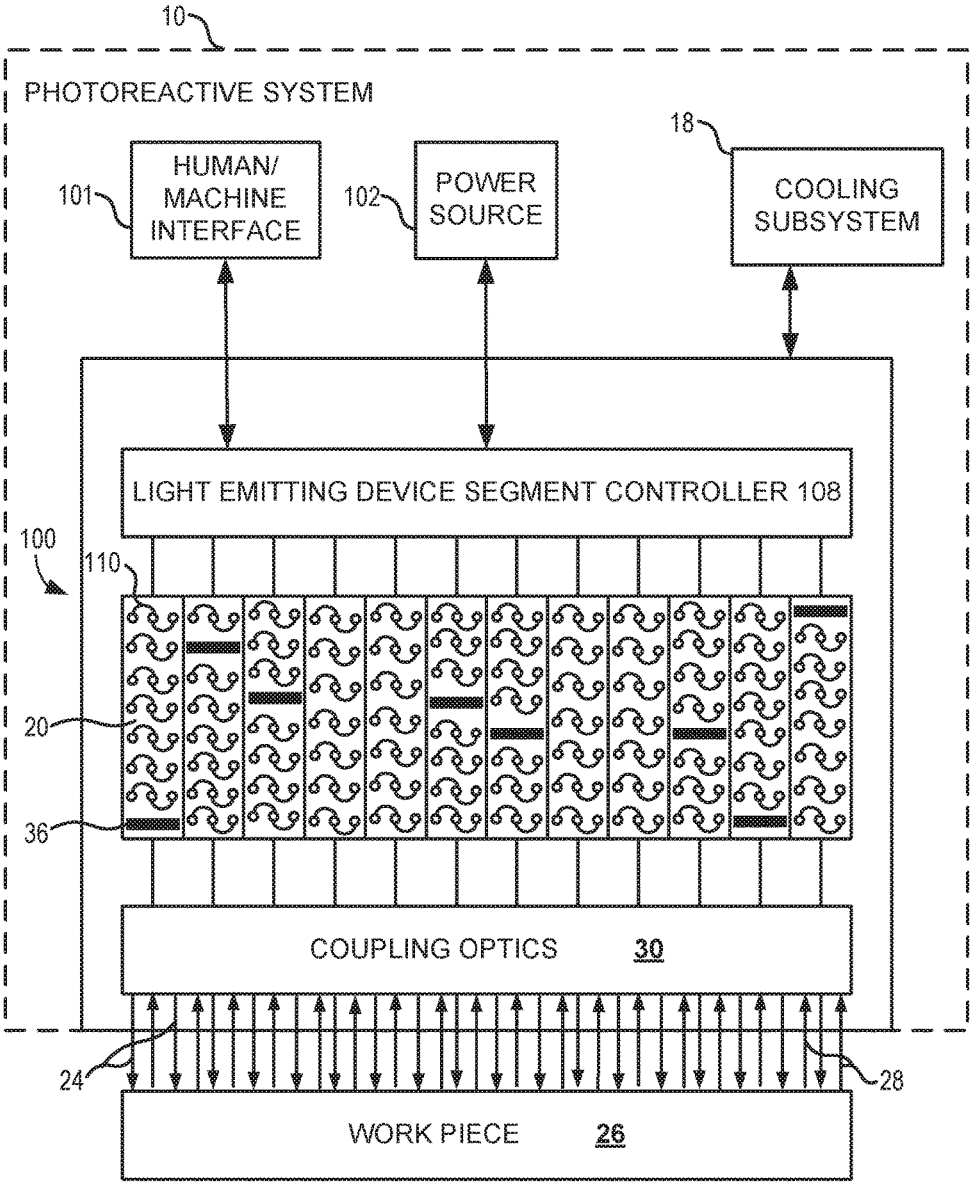
FIG. 1 shows a schematic depiction of a lighting system.

The present description is related to a lighting system with light emitting segments that may be manually controlled. FIG. 1 shows one example lighting system that includes a plurality of lighting segments. One or more of the lighting segments may be manually activated or deactivated in response to input from a human/machine interface. The human/machine interface may cooperate with the light emitting device segment control hardware circuit boards shown in FIG. 2 to select lighting segments that may be activated and/or deactivated. The light emitting device segment control hardware circuit boards may include the circuits shown in FIGS. 3 and 4. The lighting system may include lighting segments and driver circuitry as shown in FIGS. 5A and 5B. The lighting segments may be arranged as shown in FIG. 5C. The lighting system may be operated according to the method of FIG. 6.

Referring now to FIG. 1, a block diagram of a photoreactive system 10 in accordance with the system and method described herein is shown. In this example, the photoreactive system 10 comprises a lighting subsystem 100, a human/machine interface 101, light emitting device segment controller 108, a power source 102, and a cooling sub system 18.

The lighting subsystem 100 may comprise a plurality of light emitting devices 110. Light emitting devices 110 may be light emitting diodes (LED) devices, for example. Selected of the plurality of light emitting devices 110 are implemented to provide radiant output 24. The radiant output 24 is directed to a work piece 26. Returned radiation 28 may be directed back to the lighting subsystem 100 from the work piece 26 (e.g., via reflection of the radiant output 24).

The radiant output 24 may be directed to the work piece 26 via coupling optics 30. The coupling optics 30, if used, may be variously implemented. As an example, the coupling optics may include one or more layers, materials or other structure interposed between the light emitting devices 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor device providing radiant output 24 may be disposed in a respective micro-reflector, on a one-to-one basis.

Each of the layers, materials or other structure may have a selected index of refraction. By properly selecting each index of refraction, reflection at interfaces between layers, materials and other structure in the path of the radiant output 24 (and/or returned radiation 28) may be selectively controlled. As an example, by controlling differences in such indexes of refraction at a selected interface disposed between the semiconductor devices to the work piece 26, reflection at that interface may be reduced, eliminated, or minimized, so as to enhance the transmission of radiant output at that interface for ultimate delivery to the work piece 26.

The coupling optics 30 may be employed for various purposes. Example purposes include, among others, to protect the light emitting devices 110, to collect, condense and/or collimate the radiant output 24, to collect, direct or reject returned radiation 28, or for other purposes, alone or in combination. As a further example, the photoreactive system 10 may employ coupling optics 30 so as to enhance the effective quality or quantity of the radiant output 24, particularly as delivered to the work piece 26.

Selected of the plurality of light emitting devices 110 may be coupled to the light emitting device segment controller 108. As described further below, the light emitting device segment controller 108 may also include driver circuitry as discussed below.

The light emitting device segment controller 108 may interface with power source 102 and light emitting devices 110. Cooling system may circulate air or coolant responsive to light intensity output to cool light emitting devices 110 and other devices included in lighting subsystem 100.

Human/machine interface 101 may allow a human to select which light emitting segments of lighting subsystem 100 may be activated and deactivated. Further, human/machine interface 101 may allow a human to adjust intensity of light emitted via lighting subsystem 100. Human/machine interface 101 may communicate with light emitting device segment controller 108 to provide an orderly deactivation or activation of light emitting segments. Further, a light intensity command originating at human/machine interface 101 may be an input to control fan speed of cooling sub system 18.

Individual semiconductor devices 110 (e.g., LED devices) included in light emitting segments of the lighting subsystem 100 may be controlled via human/machine interface 101. For example, human/machine interface 101 may supply control signals to light emitting device segment controller 108 to adjust intensity, wavelength, and the like of a first light emitting segment, while controlling a second segment of one or more individual LED devices to emit light of a different intensity, wavelength, and the like. The first light emitting segment may be within a single array (e.g. group of light emitting devices arranged in a specific order) of semiconductor devices 110, or it may be a light emitting segment in one of a plurality of sub-lighting arrays included within an array. Human/machine interface 101 may supply control signals to activate or deactivate individual light emitting segments included in the plurality of sub-lighting arrays. For example, an array of light emitting devices may be comprised of a plurality of sub-lighting arrays, the sub-lighting arrays including a plurality of light emitting segments. The human/machine interface 101 may supply control signals to selectively activate and deactivate select light emitting segments included in the lighting array and sub-lighting arrays. In one example, human/machine interface 101 may provide control signals to deactivate light emitting arrays from an outside area of the lighting array to an inner portion of the lighting array. Likewise, the human/machine interface 101 may provide control signals to activate the light emitting arrays from the inner portion of the lighting array to the outside area of the lighting array.

The cooling subsystem 18 is implemented to manage the thermal behavior of the lighting subsystem 100. For example, generally, the cooling subsystem 18 provides for cooling of such lighting subsystem 100 and, more specifically, the semiconductor devices 110. The cooling subsystem 18 may also be implemented to cool the work piece 26 and/or the space between the work piece 26 and the photoreactive system 10 (e.g., particularly, the lighting subsystem 100). For example, cooling subsystem 18 may be an air or other fluid (e.g., water) cooling system.

The photoreactive system 10 may be used for various applications. Examples include, without limitation, curing applications ranging from ink printing to the fabrication of DVDs and lithography. Generally, the applications in which the photoreactive system 10 is employed have associated parameters. That is, an application may include associated operating parameters as follows: provision of one or more levels of radiant power, at one or more wavelengths, applied over one or more periods of time. In order to properly accomplish the photoreaction associated with the application, optical power may need to be delivered at or near the work piece at or above a one or more predetermined levels of one or a plurality of these parameters (and/or for a certain time, times or range of times).

In order to follow an intended application's parameters, the semiconductor devices 110 providing radiant output 24 may be operated in accordance with various characteristics associated with the application's parameters, e.g., temperature, spectral distribution and radiant power. At the same time, the semiconductor devices 110 may have certain operating specifications, which may be are associated with the semiconductor devices' fabrication and, among other things, may be followed in order to preclude destruction and/or forestall degradation of the devices. Other components of the photoreactive system 10 may also have associated operating specifications. These specifications may include ranges (e.g., maximum and minimum) for operating temperatures and applied, electrical power, among other parameter specifications.

Accordingly, the photoreactive system 10 supports monitoring of the application's parameters. In addition, the photoreactive system 10 may provide for monitoring of semiconductor devices 110, including their respective characteristics and specifications. Moreover, the photoreactive system 10 may also provide for monitoring of selected other components of the photoreactive system 10, including their respective characteristics and specifications.

Providing such monitoring may enable verification of the system's proper operation so that operation of photoreactive system 10 may be reliably evaluated. For example, the system 10 may be operating in an undesirable way with respect to one or more of the application's parameters (e.g., temperature, radiant power, etc.), any components characteristics associated with such parameters and/or any component's respective operating specifications. The light emitting device segment controller 108 may respond to light intensity feedback, current feedback, and/or voltage feedback to provide desired output from lighting subsystem 100.

In some applications, high radiant power may be delivered to the work piece 26. Accordingly, the lighting subsystem 100 may be implemented using an array of light emitting semiconductor devices 110. For example, the lighting subsystem 100 may be implemented using a high-density, light emitting diode (LED) array. Although LED arrays may be used and are described in detail herein, it is understood that the semiconductor devices 110, and array(s) of same, may be implemented using other light emitting technologies without departing from the principles of the description, examples of other light emitting technologies include, without limitation, organic LEDs, laser diodes, other semiconductor lasers.

The plurality of semiconductor devices 110 may be provided in the form of an array 20, or an array of sub-arrays. In one example, the array of light-emitting elements may be comprised of a Semiconductor Light Matrix™ (SLM) manufactured by Phoseon Technology, Inc. The array 20 may be implemented so that one or more, or most of the semiconductor devices 110 are configured to provide radiant output.

Figure 2:
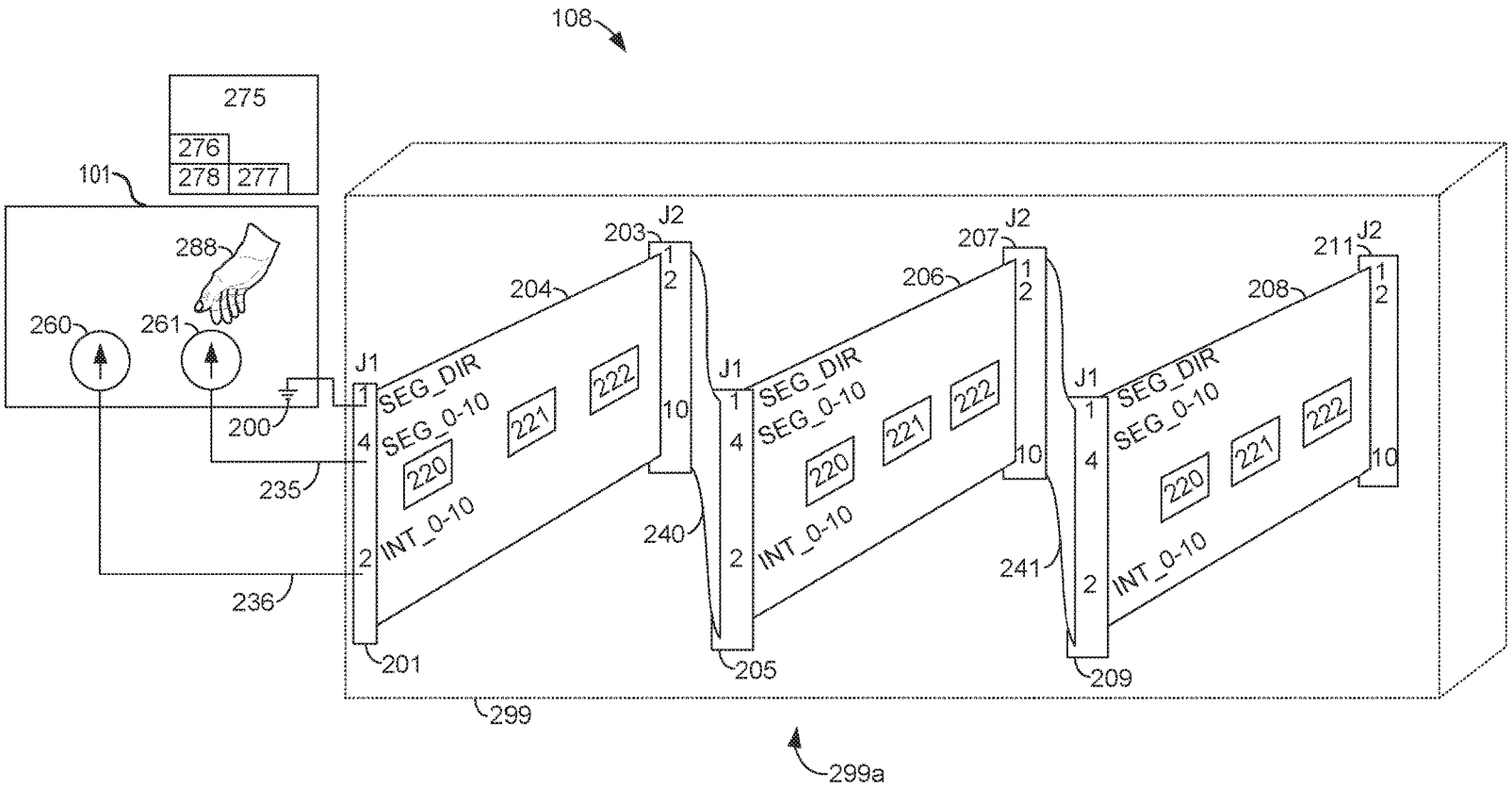
FIG. 2 shows a schematic of light emitting device segment controller hardware.

Referring to FIG. 2, a schematic of a non-limiting example of hardware for light emitting device segment controller 108 and a human/machine interface 101 is shown. It should be appreciated that the hardware described herein is non-limiting and that the concepts and methods disclosed may be applied in a variety of system configurations. For example, all transistors shown herein are N-channel devices, but similar functionality may be provided via applying P-channel devices.

In this example, light emitting device segment controller 108 includes three circuit boards 204, 206, and 208, but in other examples, light emitting device segment controller may include additional circuit boards or fewer circuit boards (e.g., a single circuit board). The circuit boards may be housed in an enclosure 299 and arranged from left to right when viewing front 299*a* of enclosure 299, where the left most circuit board is 204 (or alternatively described as the first circuit board). The center circuit board 206 (alternatively the second circuit board) is arranged between the left circuit board 204 and the right circuit board 208 (alternatively the third circuit board). The left circuit board 204 is electrically coupled to the human/machine interface 101 via conductors 235 and 236. Conductor 235 carries or supplies a 0-10 volt (SEG_0-10) lighting segment control signal from potentiometer 261 to pin 4 of connector J1 shown as element 201. Potentiometer 261 may be manipulated via human 288. Conductor 236 carries or supplies a 0-10 volt light intensity control signal from potentiometer 260 to pin 2 of connector 201. Left board 204 is also electrically coupled to ground potential 200 via pin 1 of connector 201. Pin 1 of connector 201 (J1) carries a lighting segment direction control signal SEG_DIR and it is an input to lighting segment direction control logic 220 shown in FIG. 3 and lighting segment activation/deactivation hardware 221 shown in FIG. 4. Pin 2 of connector 201 carries a light intensity signal INT_0-10 that is applied to adjust output of driver circuitry 222 shown in FIG. 5A and it is passed through to pin 2 of connector 203. Pin 4 of connector 201 carries a segment control signal SEG_0-10 that is applied to activate or deactivate selected light emitting segments 510 shown in FIG. 5A and it is passed through to pin 1 of connector 203 (J2).

Ribbon cable 240, or an alternative type of conductor, carries signals from connector 203 of left circuit board 204 to connector 205 of center circuit board 206. In particular, ribbon cable 240 electrically couples pin 10 of connector 203 to pin 1 of connector 205. Further, ribbon cable 240 electrically couples pin 1 of connector 203 to pin 4 of connector 205. Further still, ribbon cable 240 electrically couples pin 2 of connector 203 to pin 2 of connector 205. Connector 205 is electrically coupled to center circuit board 206 as is connector 207. Circuit boards 204, 206, and 208 are of identical construction so that system design may be simplified, yet provide different functionality depending on location of circuit boards within an enclosure. Similarly, ribbon cable 241 carries signals from connector 207 of center circuit board 206 to connector 209 of right circuit board 208. Specifically, ribbon cable 241 electrically couples pin 10 of connector 207 to pin 1 of connector 209. Ribbon cable 241 also electrically couples pin 1 of connector 207 to pin 4 of connector 209. Additionally, ribbon cable 241 electrically couples pin 2 of connector 207 to pin 2 of connector 209. Connector 209 is electrically coupled to right circuit board 208 as is connector 211. Connector 211 is not connected to another circuit board. Pin 10 of connectors 203, 207, and 211 is a lighting segment control input SEG_CTL_IN for each of boards 204, 206, and 208.

Thus, it may be observed that the SEG_DIR of center circuit board 206 is electrically coupled to SEG_CTL_IN of the left circuit board. In addition, the SEG_DIR of right circuit board 208 is electrically coupled to SEG_CTL_IN of the center circuit board.

It should be noted that in some alternative examples, a controller 275 including a processing unit (e.g., CPU) 276, inputs and outputs (e.g., analog outputs, analog inputs, digital inputs, and digital outputs) 277, and non-transitory memory 278. Controller 275 may be coupled to conductor 235 via inputs and outputs 277 instead of potentiometer 261 so that controller 275 may selectively activate lighting segments according to the method of FIG. 6. In particular, controller 275 may supply an analog voltage via inputs and outputs 277 that may be adjusted between 0 and 10 volts to selectively activate and deactivate lighting segments.

Figure 3:
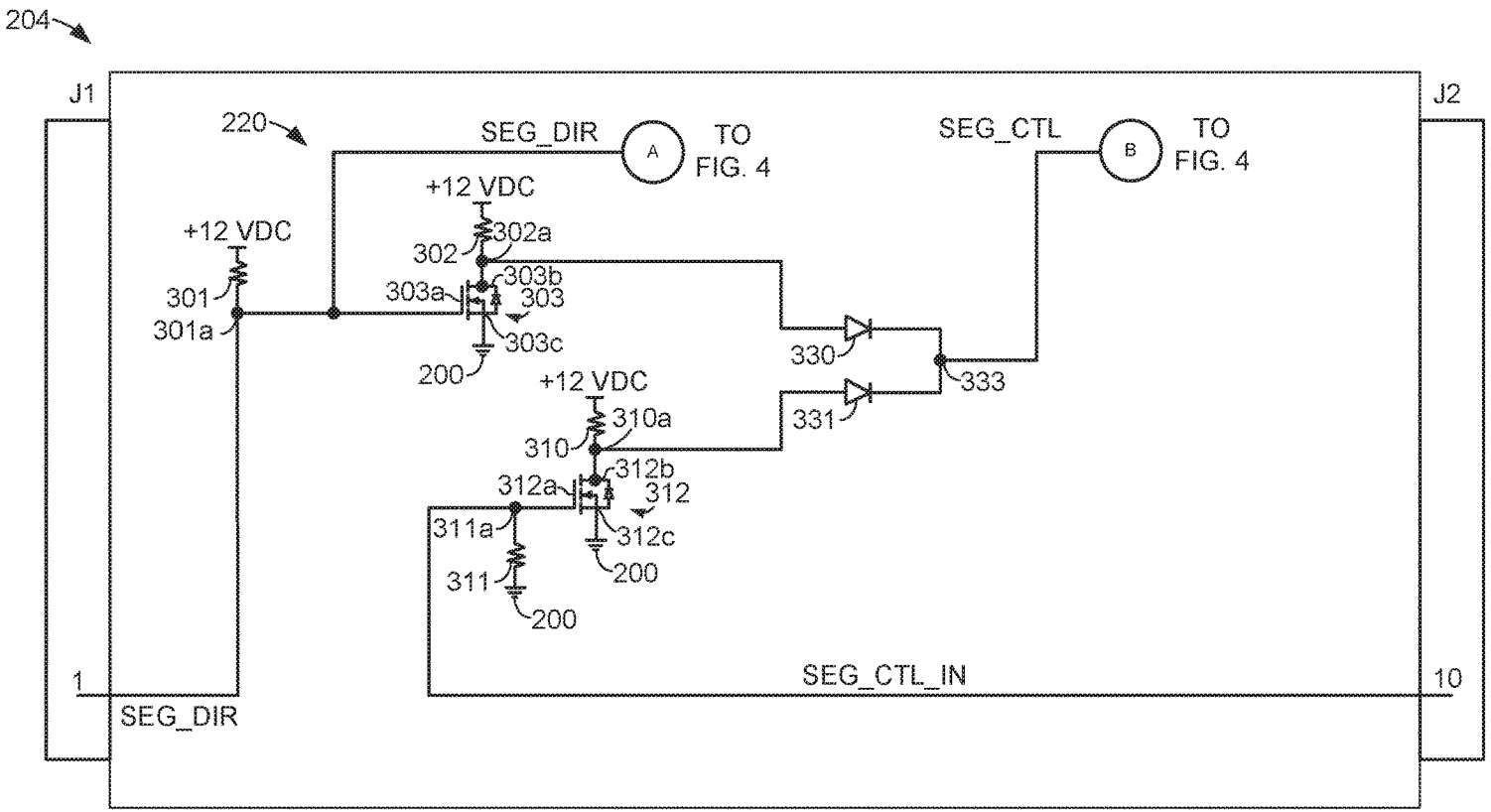
FIG. 3 shows a schematic of lighting segment direction control logic.

Referring now to FIG. 3, a schematic of lighting segment direction control logic 220 for the left 204, center 206, and right 208 circuit boards is shown. Lighting segment direction control logic 220 controls a direction that lighting segments of a lighting array or sub-lighting array are activated or deactivated. In the example described herein, adjusting segment control potentiometer 261 deactivates lighting segments sequentially beginning with outer most lighting segments to the left and right of center lighting segments in a direction toward the center lighting elements. Segment control potentiometer 261 activates lighting segments sequentially beginning with lighting segments near lighting segments at the center of the lighting array extending outward to the outer most lighting segments that are to the right and left of the center lighting segments as will be described in greater detail herein.

Lighting segment direction control logic 220 includes a lighting segment direction control signal input SEG_DIR at pin 1 of J1 (e.g., connectors 201, 205, and 209 of circuit boards 204, 206, and 208). Lighting segment direction control logic 220 includes a second input SEG_CTL_IN, which is the lighting segment control input, from pin 10 of connector J2 (e.g., connectors 203, 207, and 211 of circuit boards 204, 206, and 208). Lighting segment control logic 220 includes a segment direction control output SEG_DIR that is used via the lighting segment activation/deactivation hardware 221 elsewhere on the circuit board that includes lighting segment direction control logic 220.

Pin 1 of connector J1 is electrically coupled to pull-up resistor 301. Pull-up resistor 301 urges node 301*a* to a logical high voltage level (e.g., greater than +5 volts) when pin 1 of connector J1 is not electrically coupled to ground potential. Node 301*a* is a logical low voltage level (e.g., less than +0.5 volt) when pin 1 of connector J1 is electrically coupled to ground potential and nearly 12 volts drops across resistor 301. If node 301*a* is at a logically high voltage level, the logical high level voltage is applied to the gate 303*a* of transistor 303, thereby activating transistor 303. Current flows from drain 303*b* of transistor 303 to source 303*c* of transistor 303 when transistor 303 is activated. Source 303*c* is shown electrically coupled to ground potential 200. Current may flow into drain 303*b* from resistor 302, which is electrically coupled to +12 volts. If transistor 303 is activated, node 302*a* is at a logical low voltage and diode 330 prevents current flow to node 302*a* if node 333 is at a logically high voltage level. Conversely, if transistor 303 is not activated and current does not flow from drain 303*b* to source 303*c*, then node 302*a* is at a logically high voltage level such that node 333 is at a logically high voltage level. The voltage at pin 1 of J1 or at node 301*a* is at a logical high level for the center circuit board and the right circuit board because of pull-up resistor 301 and pin 1 of J1 of the center and right circuit boards not being electrically coupled to ground potential.

Pin 10 of connector J2 is electrically coupled to pull-down resistor 311. Pull-down resistor 311 urges node 311*a* to a logical low voltage level when pin 10 of connector J2 is open circuited. This is the case when lighting segment direction control logic 220 is part of the right circuit board 208. Node 311*a* is a logical high voltage level when pin 10 of connector J2 is electrically coupled to +12 volts via a resistor (e.g., resistor 301 of the center circuit board 206 or right circuit board 208). Resistor 311 and resistor 301 of an adjacent circuit board may form a voltage divider network that provides a logical high voltage level at node 311*a*. If node 311*a* is at a logically high voltage level, the logical high level voltage is applied to the gate 312*a* of transistor 312, thereby activating transistor 312. Current flows from drain 312*b* of transistor 312 to source 312*c* of transistor 312 when transistor 312 is activated. Source 312*c* is shown electrically coupled to ground potential 200. Current may flow into drain 312*b* from resistor 310, which is electrically coupled to +12 volts. If transistor 312 is activated, node 310*a* is at a logical low voltage and diode 331 prevents current flow to node 310*a* if node 333 is at a logically high voltage level. Conversely, if transistor 303 is not activated and current does not flow from drain 303*b* to source 303*c*, then node 302*a* is at a logically high voltage level such that node 333 is at a logically high voltage level. The voltage at pin 10 of J2 or at node 311*a* is at a logical low level for the right circuit board 208 because of pull-down resistor 311 and pin 10 of J2 of the right circuit board being open circuited. The voltage at pin 10 of J2 or at node 311*a* is at a logical high level for the center circuit board 206 and the left circuit board 204 because of pull-up resistors 301 and pin 10 of J2 of the left and center circuit boards being electrically coupled to resistors 301 of the center and right circuit boards. Table 350 describes the logical states of the inputs SEG_DIR and SEG_CTL_IN along with the state of output SEG_CTL for lighting segment direction control logic 220. For example, for the left circuit board 204, SEG_DIR is at a logical low level (e.g., value of zero) and SEG_CTL_IN is at a logical high level (e.g., value of one), which provides an output SEG_CTL at a logical high level. For the center circuit board 206, SEG_DIR is at a logical high level and SEG_CTL_IN is at a logical high level, which provides an output SEG_CTL at a logical low level.

Figure 4:
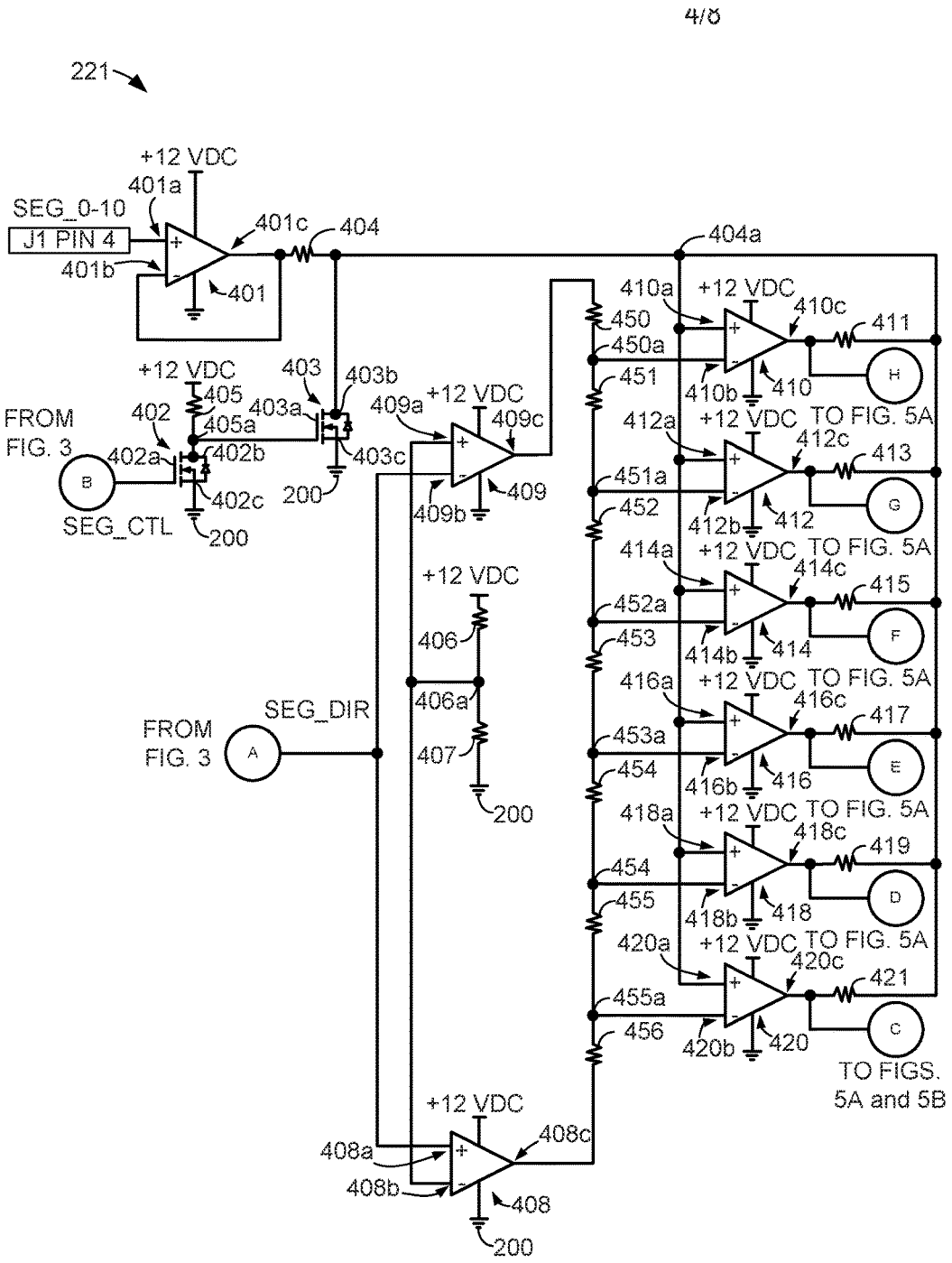
FIG. 4 shows a schematic of lighting segment activation and deactivation circuitry.
Figure 5A:
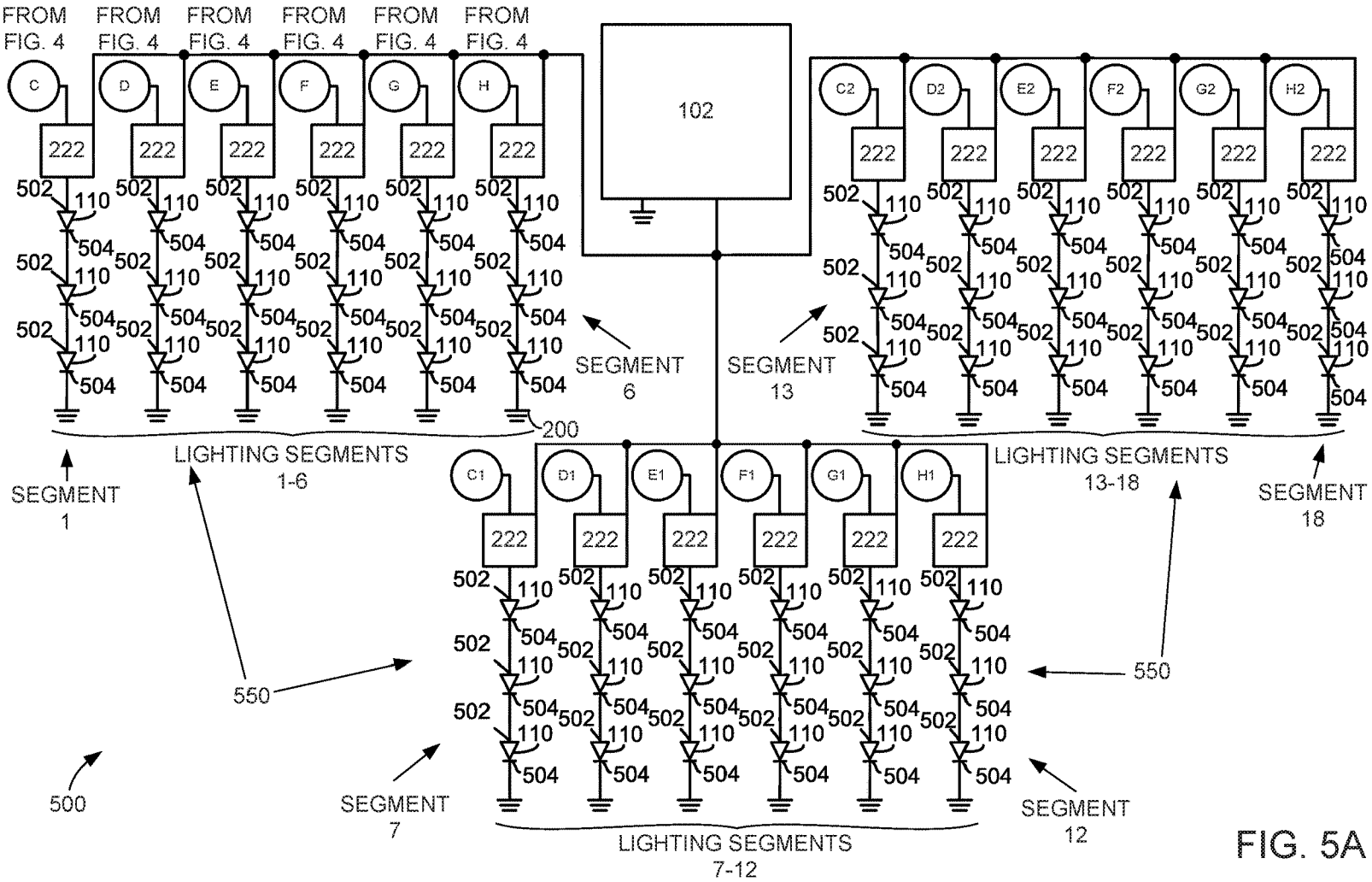
FIG. 5A shows a schematic of a lighting array including lighting segments and lighting segment driver circuitry.
Figure 5B:
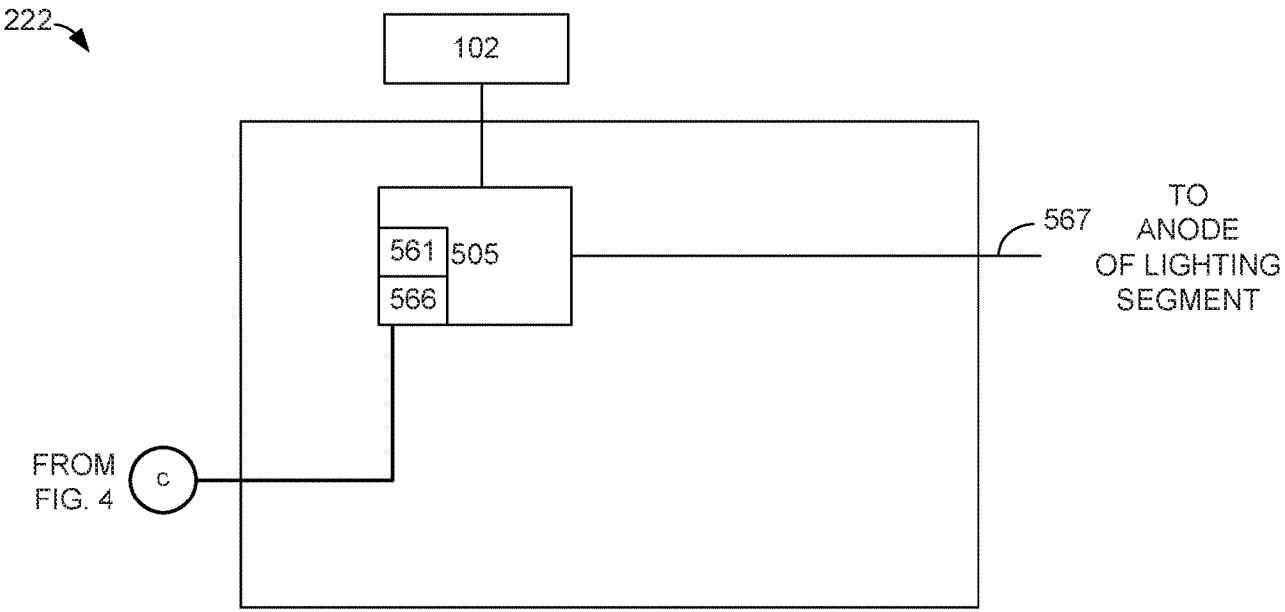
FIG. 5B shows a detailed block diagram of lighting segment driver circuitry.
Figure 5C:
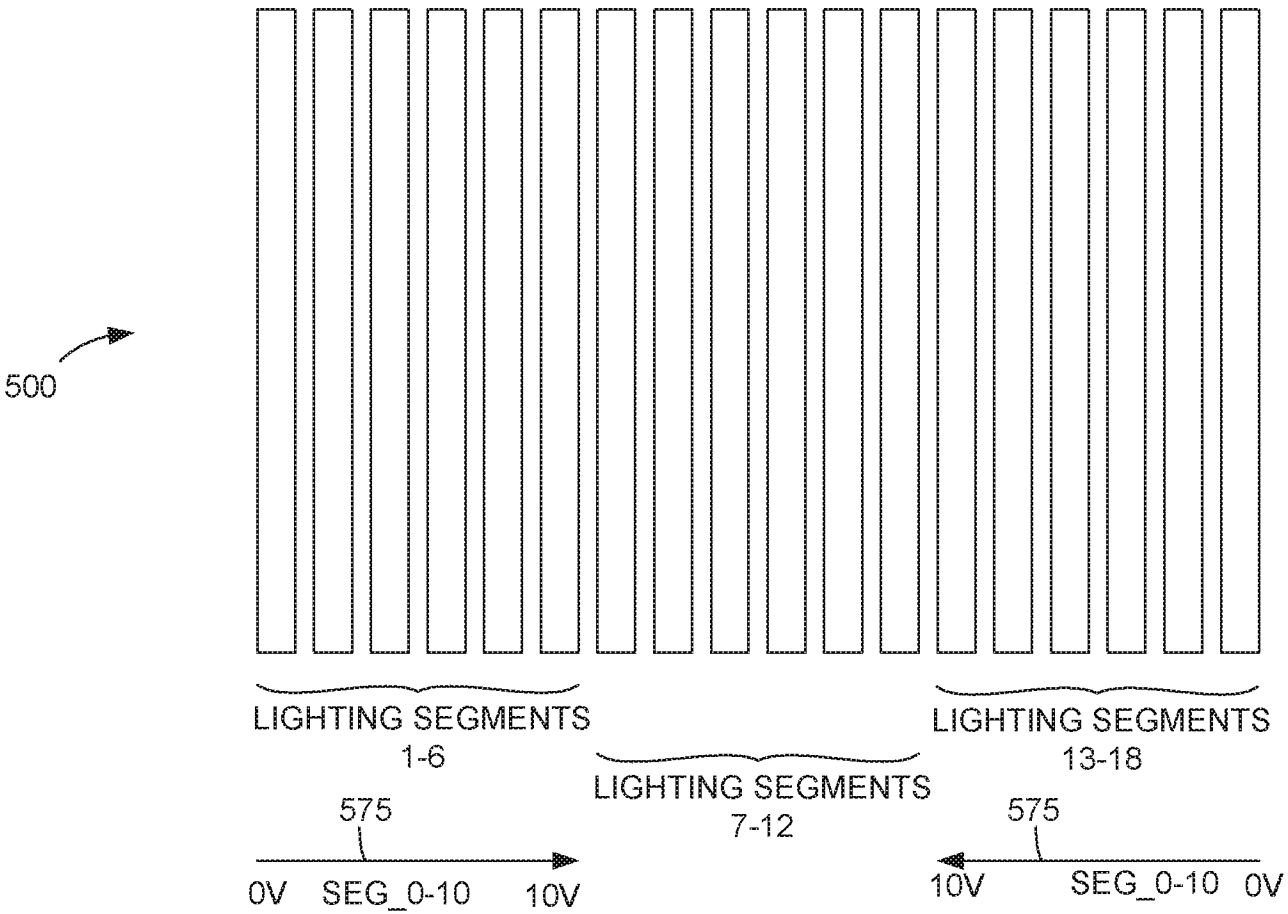
FIG. 5C shows an example lighting segment arrangement.

Referring now to FIG. 4, a schematic of lighting segment activation/deactivation circuitry is shown. Segment activation/deactivation circuitry 221 is included with each of left circuit board 204, center circuit board 206, and right circuit board 208. The circuitry includes a lighting segment control signal analog voltage input SEG_0-10, a logic level lighting segment control signal SEG_CTL, and a logic level lighting segment direction control signal SEG_DIR. In this example, segment activation/deactivation circuitry 221 is shown for left circuit board 204. The exact same hardware is provided for center circuit board 206 and right circuit board 208, but it is not shown for the sake of brevity.

The lighting segment control signal analog voltage input SEG_0-10 is received from potentiometer 261 via pin 4 of connector J1 and it is input to non-inverting input 401*a* of operational amplifier 401. The inverting input 401*b* of operational amplifier 401 is directly electrically coupled to output 401*c* of operational amplifier 401 to operate operational amplifier in a voltage follower mode where a voltage provided at output 401*c* follows a voltage at non-inverting input 401*a*. The voltage output from output 401*c* is then applied to non-inverting inputs 410*a*, 412*a*, 414*a*, 416*s*, 418*a*, and 420*a* of comparators 410, 412, 414, 416, 418, and 420 if transistor 403 is not activated. Resistor 404 prevents output 401*c* being electrically coupled to ground potential 200 if transistor 403 is activated. Output of operational amplifier 401 is also coupled to outputs of comparators 410, 412, 414, 416, 418, and 420 via resistors 404, 411, 413, 415, 417, 419, and 421.

The logic level lighting segment control signal SEG_CTL is input to base 402*a* of transistor 402. Transistor 402 may be activated when SEG_CTL is at a high logical level. Current may flow from drain 402*b* to source 402*c* when transistor 402 is activated. Current flow is prevented from drain 402*b* to source 402*c* when transistor 402 is deactivated. A logical high voltage is presented at node 405*a* when transistor 402 is deactivated. A logical low voltage is presented at node 405*a* when transistor 402 is activated. Similarly, transistor 403 may be activated when a high logical level is applied to base 403*a*. Current may flow from drain 403*b* to source 403*c* when transistor 403 is activated. Current flow is prevented from drain 403*b* to source 403*c* when transistor 403 is deactivated (e.g., when a logical low level is applied to base 403*a*). Thus, voltage at node 404 is nearly zero, which allows all lighting segments electrically coupled to the circuit board to remain on, when input SEG_CTL is at a low logical voltage. Such a condition is only permitted when the circuit board is the center circuit board 206 shown in FIG. 2 as indicated by logic table 350 of FIG. 3. Otherwise, the voltage at node 404*a* follows the voltage output at output 401*c*.

Comparators 408, 409, 410, 412, 414, 416, 418, and 420 operate according to the following description. If a first voltage is applied to the +input of the comparator (e.g., 408*a*, 409*a*, 410*a*, 412*a*, 414*a*, 416*a*, 418*a*, and 420*a*) and a second voltage is applied to the—input of the comparator (e.g., 408*b*, 409*b*, 410*b*, 412*b*, 414*b*, 416*b*, 418*b*, and 420*b*), and if the second voltage is less than the first voltage, then the output of the comparator (e.g., 408*c*, 409*c*, 410*c*, 412*c*, 414*c*, 416*c*, 418*c*, and 420*c*) is a logical high level (e.g., greater than 8 volts). Thus, if the +input of comparator 409 is at 10 volts and the—input of comparator 409 is at 0.5 volts, the output of comparator 409 is greater than 8 volts. Conversely, if 0.25 volts is applied to the +input of comparator 409 and 05 volts is applied to the—input of comparator 409, then the output of comparator 409 is a logical low voltage (e.g., less than 0.5 volts). All of the comparators 408, 409, 410, 412, 414, 416, 418, and 420 operate in this way.

Resistor 406 is electrically coupled to +12 volts and resistor 407. Resistor 407 is also electrically coupled to ground potential 200. As such, resistors 406 and 407 provide a voltage divider that outputs a predetermined voltage that is the basis for comparing against the logical voltage level of SEG_DIR that is applied to comparator inputs 409*b* and 408*a*. Comparators 408 and 409 may be described as direction control comparators since they determine what voltage is applied to comparators 410, 412, 414, 416, 418, and 420, thereby controlling whether voltage across resistors 450, 451, 452, 453, 454, 455, and 456 decreases or increases from output 408*c* to output 409*c*. And, the direction that voltage increases or decreases from output 408*c* to 809*c* across resistors 450-456, determines which direction in the lighting array that lighting segments are activated or deactivated. In one example, the voltage at node 406*a* is approximately 6 volts so that a voltage greater than 6 volts may be interpreted as a logical high voltage and a voltage less than 6 volts may be interpreted as a logical low voltage.

As previously noted in logic table 350, the signal SEG_DIR is a logical high level (e.g., greater than 6 volts) when the circuit board is the right circuit board 208. Conversely, the signal SEG_DIR is a logical low level (e.g., less than 0.5 volts) when the circuit board is the left circuit board 204. The state of SEG_DIR is irrelevant when the circuit board is the center circuit board because the signal SEG_CTL pulls node 404*a* to ground potential.

Thus, if circuit 221 is on the left most circuit board 204, comparator 409 outputs a voltage of about 10 volts and comparator 408 outputs a low voltage (e.g., less than 0.5 volts) since SEG_DIR is at a logical low level as shown in table 350 of FIG. 3. As such, a voltage drop occurs from a voltage at output 409*c* to a voltage at 408*c*. A voltage drop occurs across each of resistors 451-456 and a highest voltage is then applied to input 410*b* followed by a slightly lower voltage being applied to input 412*b*, followed by a slightly lower voltage being applied to input 414*b*, and so on until a lowest voltage is applied at input 420*b*. Thus for example, if comparator 409 outputs a voltage of 10 volts and a voltage drop of 1.43 volts occurs across each resistor 450-456, then approximately 8.57 volts is applied to input 410*b* and 1.43 volts is applied to input 420*b* with voltages between 8.57 volts and 1.43 volts being applied at inputs 412*b*, 414*b*, 416*b*, and 418*b*, the voltage being reduced in a direction from resistor 450 to resistor 456. By adjusting a position of potentiometer 261 shown in FIG. 2, the voltages applied to inputs 410*a*, 412*a*, 414*a*, 416*a*, 418*a*, and 420*a* may be changed such that outputs 410*c*, 412*c*, 414*c*, 416*c*, 418*c*, and 420*c* may change from a logical high level to a logical low level to selectively activate and deactivate light emitting segments. In one example, when the voltage from potentiometer 261 is increased from zero volts to ten volts, output of comparator 420 changes from a logical low level to a logical high level as the voltage of the potentiometer begins to increase. Once output of comparator 420 changes to a logical high level, it is followed by the output of comparator 418 changing from a logical low level to a logical high level as the voltage from the potentiometer continues to increase. Likewise, output of comparators 416, 414, 412, and 410 may transition from logical low levels to logical high levels in one after the other order as potentiometer voltage increases. One lighting segment is deactivated for each comparator output that changes from a logical low level to a logical high level.

Thus, a plurality of voltage levels may be provided between resistors 450 and 456 via selecting values of resistors that form a voltage dividing network. In addition, output of comparator 408 and comparator 409 may be reversed to control a direction and order of voltages that are compared to the command voltage so that the single board design may control a direction in which lighting segments may be activated and deactivated. For example, the output of comparator 408 may be zero volts and output of comparator 409 may be 10 volts. Alternatively, to change the order comparators 410, 412, 414, 416, 418, and 420 respond to command voltage (e.g., SEG_0-10) at node 404*a*, the output of comparator 408 may be 10 volts and the output of comparator 409 may be zero volts.

On the other hand, if circuit 221 is on the right most circuit board 208, comparator 408 outputs a voltage of about 10 volts and comparator 409 outputs a low voltage (e.g., less than 0.5 volts) since SEG_DIR is at a logical high level as shown in table 350 of FIG. 3. Therefore, a voltage drop occurs from a voltage at output 408*c* to a voltage at 409*c*. A voltage drop occurs across each of resistors 451-456 and a highest voltage is then applied to input 420*b* followed by a slightly lower voltage being applied to input 418*b*, followed by a slightly lower voltage being applied to input 416*b*, and so on until a lowest voltage is applied at input 410*b*. Thus for example, if comparator outputs a voltage of 10 volts and a voltage drop of 1.43 volts occurs across each resistor 450-456, then approximately 8.57 volts is applied to input 420*b* and 1.43 volts is applied to input 410*b* with voltages between 8.57 volts and 1.43 volts being applied at inputs 418*b*, 416*b*, 414*b*, and 412*b*, the voltage being reduced in a direction from resistor 456 to resistor 450. By adjusting a position of potentiometer 261 shown in FIG. 2, the voltages applied to inputs 420*a*, 418*a*, 416*a*, 414*a*, 412*a*, and 410*a* may be changed such that outputs change in order from 420*c*-410*c* according to the sequence 420*c*, 418*c*, 416*c*, 414*c*, 412*c*, and 410*c*. The outputs may change from a logical low level to a logical high level and vice versa to selectively activate and deactivate light emitting segments. In one example, when the voltage from potentiometer 261 is increased from zero volts to ten volts, output of comparator 410 changes from a logical low level to a logical high level as the voltage of the potentiometer begins to increase. Once output of comparator 410 changes to a logical high level, it is followed by the output of comparator 412 changing from a logical low level to a logical high level as the voltage from the potentiometer continues to increase. Likewise, output of comparators 414, 416, 418, and 420 may transition from logical low levels to logical high levels in one after the other order as potentiometer voltage increases. One lighting segment is deactivated for each comparator output that changes from a logical low level to a logical high level. The outputs of comparators 410, 412, 414, 416, 418, and 420 coupled to lighting segment driver circuits shown in FIG. 5A according to reference letters C, D, E, F, G, and H.

Thus, circuitry 221 is configured to deactivate lighting segments by changing states of comparator outputs 410*c*, 412*c*, 414*c*, 416*c*, 418*c*, 420*c* in an order of 410*c* to 412*c* to 414*c* to 416*c* to 418*c* to 420*c* when circuitry 221 is part of right circuit board 208. Further, circuitry 221 is configured to deactivate lighting segments by changing states of outputs 410*c*, 412*c*, 414*c*, 416*c*, 418*c*, 420*c* in an order of 420*c* to 418*c* to 416*c* to 414*c* to 412*c* when circuitry 221 is part of left circuit board 204 since the states of SEG_DIR and SEG_CTL depend on which position the circuit board assumes in a controller enclosure. As such, a single hardware design may be provided on a circuit board and the functionality of the circuit board is dependent on its position within an enclosure. Further, the positioning of the circuit boards in the enclosure and the logical states that are dependent on circuit board position within the enclosure provides for individual control over lighting segments of different sub-arrays.

Referring now to FIG. 5A, a schematic of an example lighting array including lighting segments and lighting segment driver circuitry is shown. In this example, lighting array 500 includes eighteen lighting segments 550. The lighting segments 550 are comprised of semiconductor devices 110 that have an anode 502 and a cathode 540. The semiconductors are electrically coupled in series cathode to anode in each lighting segment. In this example, each lighting segment includes three semiconductor devices 110 arranged in series, but in other examples, additional semiconductor devices 110 may be added to the series arrangement. In addition, one semiconductor 110 in each lighting segment is electrically coupled to driver circuitry 222 and another semiconductor 110 in each lighting segment is electrically coupled to ground potential 200. Driver circuitry 222 is provided electrical power from power source 102.

A first group of lighting segments are numbered 1-6. This group of lighting segments may be referred to as a sub-array. The first group of lighting segments may be selectively activated or deactivated responsive to human input to potentiometer 261 shown in FIG. 2 in addition to machine power activation or deactivation. Further, left circuit board 204 shown in FIG. 2 interfaces with driver circuits 222 as indicated by bubble references C-H to selectively activate and deactivate lighting segments 550.

A second group of lighting segments are numbered 7-12. This group of lighting segments may also be referred to as a sub-array. The second group of lighting segments are not selectively activated and deactivated responsive to human input to potentiometer 261. The center circuit board 206 shown in FIG. 2 interfaces with driver circuits 222 as indicated by bubble references C1-H1; however, corresponding bubbles for center circuit board 206 are not included since reproduction of FIG. 4 to show circuitry of circuit board 206 was omitted for the sake of brevity.

FIG. 5A also includes a third group of lighting segments are numbered 13-18. This group of lighting segments may also be referred to as a sub-array. The third group of lighting segments are selectively activated and deactivated responsive to human input to potentiometer 261 similar to the first group of lighting segments. The right circuit board 208 shown in FIG. 2 interfaces with driver circuits 222 as indicated by bubble references C2-H2; however, corresponding bubbles for the right most circuit board 208 are not included since reproduction of FIG. 4 to show circuitry of circuit board 208 was omitted for the sake of brevity.

In one example, increasing the voltage output from potentiometer 261 shown in FIG. 2 from 0 to 10 volts begins by deactivating lighting segments 1 and 18 located at the extents or outer boundary of lighting array 500, then as the voltage from potentiometer 261 increases, lighting segments 2 and 17 are deactivated (e.g., cease to illuminate). As the voltage from potentiometer 261 increases further, lighting segments 3 and 16 are deactivated. If the human operator continues to increase voltage output via potentiometer 261, then lighting segments 4 and 15 are deactivated. Further increasing potentiometer output voltage deactivates lighting segments 5 and 14. Finally, lighting segments 6 and 13 are deactivated near when potentiometer output approaches 10 volts. If output of the potentiometer is reduced from 10 volts to 0 volts, the lighting segments are activated (e.g., begin to illuminate) in a reverse order (e.g., from lighting segment 6 to 1 and from lighting segment 13 to 18. Lighting segments 7-12 remain illuminated whether output from potentiometer 261 increases or decreases in voltage.

Referring now to FIG. 5B, a detailed block diagram of lighting segment driver circuitry 222 is shown. In one example, lighting segment driver circuitry 222 includes a buck voltage regulator 505 that reduces voltage provided by power source 102 to power a lighting segment 550 as shown in FIG. 5A. The buck voltage regulator 505 includes a signal duty cycle generator circuit 561 that supplies a variable duty cycle signal that controls the power provided via buck voltage regulator 505. Lighting segment driver circuitry 222 also includes a transistor 566 that when activated via a logical high voltage level reduces the duty cycle of signal duty cycle generator circuit 561 to zero, thereby deactivating the buck voltage regulator 505 and ceasing to supply power to the lighting segment 550 (not shown) that is electrically coupled to driver circuitry 222. Buck voltage regulator 505 may operate responsive to a varying duty cycle signal when transistor 566 is not activated. A driver circuit 222 is included with each lighting segment as shown in FIG. 5A. The output 567 of buck voltage regulator 505 is electrically coupled to an anode of a lighting device in a lighting segment as shown in FIG. 5A Referring now to FIG. 5C, a schematic showing example physical positions of lighting segments 550 in lighting array 500 is presented. In this example, lighting segments 550 are arranged side by side from 1-18. The left most lighting segment is segment number one and the right most segment is segment number 18. The circuitry shown in FIGS. 2-5B may deactivate lighting segments 1-6 and 13-18 as described herein. In particular, when output of potentiometer 261 of FIG. 2 is increases from zero volts to exceed a first threshold voltage, lighting segments numbered 1 and 18 are deactivated. If the output of potentiometer 261 is increased further to exceed a second threshold voltage, lighting segments numbered 2 and 17 are then deactivated while lighting segments numbered 1 and 18 remain off. Further, if the output of potentiometer 261 is increased further to exceed a third threshold voltage, lighting segments numbered 3 and 16 are then deactivated while lighting segments numbered 1, 18, 2, and 17 remain off. This sequence of deactivating lighting segments may continue when output voltage of potentiometer continues to 10 volts such that output of potentiometer 10 exceeds six threshold voltage levels, where two lighting segments are deactivated each time a different threshold voltage level is exceeded. The lighting segments may be reactivated via reducing the output voltage of the potentiometer from 10 volts to 0 volts, such that each time output of the potentiometer is reduced to less than a threshold voltage, two lighting segments are reactivated via the circuitry shown in FIGS. 2-5B.

In this way, activated lighting segments may be deactivated from outermost lighting segments in the lighting array to innermost lighting segments in the array. In this example, lighting segments 7-12 are not deactivated responsive to output of potentiometer 261.

Thus, the system of FIGS. 1-5C provides for a lighting system, comprising: a plurality of lighting segment driver circuits, each of the plurality of lighting segment driver circuits electrically coupled to a lighting segment; and a plurality of circuit boards including the plurality of lighting segment driver circuits, each of the plurality of circuit boards identical to the other of the plurality of circuit boards, each of the plurality circuit boards including comparator circuits that are in electrical communication with the plurality of lighting segment driver circuits. The lighting system includes where the plurality of lighting segments is an actual total number of lighting segments, where the plurality of circuit boards is an actual total number of circuit boards, and where the actual total number of lighting segments divided by the actual total number of circuit boards is an integer. The lighting system includes where the plurality of circuit boards is an actual total of three circuits boards, and where a second of the three circuit boards does not selectively deactivate any of the plurality of lighting segment driver circuits in response to a command voltage.

In some examples, the lighting system includes where a first and a third of the three circuit boards selectively deactivate one or more of the plurality of lighting segment driver circuits in response to the command voltage. The lighting system includes where the command voltage is provided via a potentiometer. The lighting system further comprises lighting segment direction control logic on each of the plurality of circuit boards. The method includes where the lighting segment direction control logic provides a voltage level that causes a first comparator to output a first voltage and a second comparator to output a second voltage, the first voltage greater than the second voltage.

The system of FIGS. 1-5C also provides or a lighting system, comprising: a plurality of lighting segment driver circuits, each of the plurality of lighting segment driver circuits electrically coupled to a lighting segment, the plurality of lighting segment driver circuits included on a single circuit board; and lighting segment activation and deactivation circuitry electrically coupled to the lighting segment driver circuits, the lighting segment activation and deactivation circuits including a plurality of voltage sensing comparator circuits, each of the plurality of voltage sensing comparator circuits electrically coupled to one of the plurality of lighting segment driver circuits, each of the plurality of voltage sensing comparator circuits deactivating one of the plurality of lighting segment driver circuits in response to a voltage different than voltages that the other of the plurality of voltage sensing comparator circuits deactivate other lighting segment driver circuits. The lighting system further comprises a plurality of resistors electrically coupling output of a first direction control comparator and output of a second direction control comparator.

In some examples, the lighting system includes where the plurality of resistors are electrically coupled to the plurality of voltage sensing comparators. The lighting system includes where the plurality of voltage sensing comparators are further electrically coupled to a command voltage. The lighting system includes where the command voltage is provided via a potentiometer. The lighting system includes where each of the plurality of lighting segment driver circuits includes a buck voltage regulator and a transistor to deactivate the buck voltage regulator. The lighting system includes where only one of the plurality of voltage sensing comparators is directly electrically coupled to the transistor.

Figure 6:
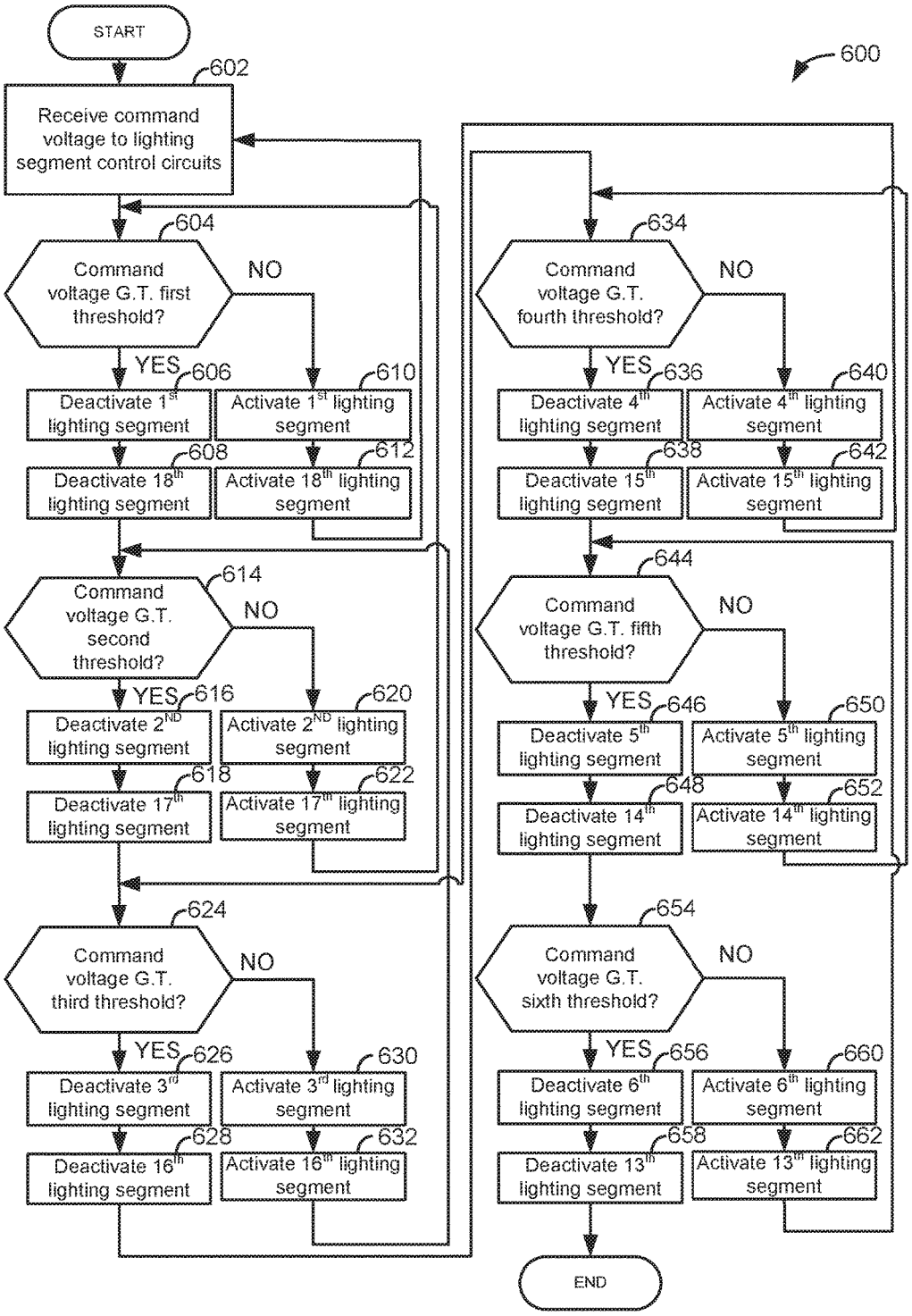
FIG. 6 is a flow chart of a method for operating a lighting system.

Referring now to FIG. 6, a method for operating a lighting system is presented. The method of FIG. 6 may be performed via the system described in FIGS. 1-5B. In some examples, a human may perform at least some actions recited in the method. Alternatively, a controller may perform at least some actions recited in the method via executable instructions stored in non-transitory memory of the controller.

At 602, a command voltage that may be the basis for activating and deactivating lighting segments is received via the hardware shown in FIGS. 1-5B. In one example, the command voltage is an analog voltage and it is received via operational amplifier 401 shown in FIG. 4. Method 600 proceeds to 604.

At 604, method 600 judges if the command voltage is greater than a first threshold voltage. In one example, resistors 450, 451, 452, 453, 554, 455, and 456 have resistance values that provide uniform equal voltage drops across each resistor such that 10 volts between output 409*c* and 408*c* is reduced by predetermined (e.g., 1.43 volts) substantially equal amounts (e.g., ±5%) for each resistor. Thus, the first threshold voltage may be 1.43 volts. If method 600 judges that the command voltage is greater than 1.43 volts, the answer is yes and method 600 proceeds to 606. Otherwise, the answer is no and method 600 proceeds to 610.

At 606, method 600 deactivates a first lighting segment via commanding output of comparator 420 on. Commanding the comparator on adjusts the duty cycle of a buck voltage regulator to zero duty cycle, thereby ceasing electric power delivery to the first lighting segment. Method 600 proceeds to 608.

At 608, method 600 deactivates an eighteenth lighting segment via commanding output of a comparator on. Commanding the comparator on adjusts the duty cycle of a buck voltage regulator to zero duty cycle, thereby ceasing power delivery to the eighteenth lighting segment. Method 600 proceeds to 614.

At 610, method 600 activates the first lighting segment via commanding output of comparator 420 off. Commanding the comparator off allows a duty cycle of a buck voltage regulator to resume, thereby providing power delivery to the first lighting segment. Method 600 proceeds to 612.

At 612, method 600 activates the eighteenth lighting segment via commanding output of a comparator off. Commanding the comparator off adjusts the duty cycle of a buck voltage regulator to resume, thereby providing power delivery to the eighteenth lighting segment. Method 600 returns to 602 so that lighting segments later in the segment deactivation order may not be deactivated unless lighting segments earlier in the segment deactivation order are already deactivated.

At 614, method 600 judges if the command voltage is greater than a second threshold voltage. The, the second threshold voltage may be 2.85 volts. If method 600 judges that the command voltage is greater than 2.85 volts, the answer is yes and method 600 proceeds to 616. Otherwise, the answer is no and method 600 proceeds to 620.

At 616, method 600 deactivates a second lighting segment via commanding output of comparator 418 on. Commanding the comparator on adjusts the duty cycle of a buck voltage regulator to zero duty cycle, thereby ceasing power delivery to the second lighting segment. Method 600 proceeds to 618.

At 618, method 600 deactivates a seventeenth lighting segment via commanding output of a comparator on. Commanding the comparator on adjusts the duty cycle of a buck voltage regulator to zero duty cycle, thereby ceasing power delivery to the seventeenth lighting segment. Method 600 proceeds to 624.

At 620, method 600 activates the second lighting segment via commanding output of comparator 418 off. Commanding the comparator off allows a duty cycle of a buck voltage regulator to resume, thereby providing power delivery to the second lighting segment. Method 600 proceeds to 622.

At 622, method 600 activates the seventeenth lighting segment via commanding output of a comparator off. Commanding the comparator off adjusts the duty cycle of a buck voltage regulator to resume, thereby providing power delivery to the seventeenth lighting segment. Method 600 returns to 604.

At 624, method 600 judges if the command voltage is greater than a third threshold voltage. Thus, the third threshold voltage may be 4.28 volts. If method 600 judges that the command voltage is greater than 4.28 volts, the answer is yes and method 600 proceeds to 626. Otherwise, the answer is no and method 600 proceeds to 630.

At 626, method 600 deactivates a third lighting segment via commanding output of comparator 416 on. Commanding the comparator on adjusts the duty cycle of a buck voltage regulator to zero duty cycle, thereby ceasing power delivery to the third lighting segment. Method 600 proceeds to 628.

At 628, method 600 deactivates a sixteenth lighting segment via commanding output of a comparator on. Commanding the comparator on adjusts the duty cycle of a buck voltage regulator to zero duty cycle, thereby ceasing power delivery to the sixteenth lighting segment. Method 600 proceeds to 634.

At 630, method 600 activates the third lighting segment via commanding output of comparator 416 off. Commanding the comparator off allows a duty cycle of a buck voltage regulator to resume, thereby providing power delivery to the third lighting segment. Method 600 proceeds to 632.

At 632, method 600 activates the sixteenth lighting segment via commanding output of a comparator off. Commanding the comparator off adjusts the duty cycle of a buck voltage regulator to resume, thereby providing power delivery to the sixteenth lighting segment. Method 600 returns to 614.

At 634, method 600 judges if the command voltage is greater than a fourth threshold voltage. Thus, the fourth threshold voltage may be 5.71 volts. If method 600 judges that the command voltage is greater than 5.71 volts, the answer is yes and method 600 proceeds to 636. Otherwise, the answer is no and method 600 proceeds to 640.

At 636, method 600 deactivates a fourth lighting segment via commanding output of comparator 414 on. Commanding the comparator on adjusts the duty cycle of a buck voltage regulator to zero duty cycle, thereby ceasing power delivery to the fourth lighting segment. Method 600 proceeds to 638.

At 638, method 600 deactivates a fifteenth lighting segment via commanding output of a comparator on. Commanding the comparator on adjusts the duty cycle of a buck voltage regulator to zero duty cycle, thereby ceasing power delivery to the fifteenth lighting segment. Method 600 proceeds to 644.

At 640, method 600 activates the fourth lighting segment via commanding output of comparator 414 off. Commanding the comparator off allows a duty cycle of a buck voltage regulator to resume, thereby providing power delivery to the fourth lighting segment. Method 600 proceeds to 642.

At 642, method 600 activates the fifteenth lighting segment via commanding output of a comparator off. Commanding the comparator off adjusts the duty cycle of a buck voltage regulator to resume, thereby providing power delivery to the fifteenth lighting segment. Method 600 returns to 624.

At 644, method 600 judges if the command voltage is greater than a fifth threshold voltage. Thus, the fifth threshold voltage may be 7.14 volts. If method 600 judges that the command voltage is greater than 7.14 volts, the answer is yes and method 600 proceeds to 646. Otherwise, the answer is no and method 600 proceeds to 650.

At 646, method 600 deactivates a fifth lighting segment via commanding output of comparator 412 on. Commanding the comparator on adjusts the duty cycle of a buck voltage regulator to zero duty cycle, thereby ceasing power delivery to the fifth lighting segment. Method 600 proceeds to 648.

At 648, method 600 deactivates a fourteenth lighting segment via commanding output of a comparator on. Commanding the comparator on adjusts the duty cycle of a buck voltage regulator to zero duty cycle, thereby ceasing power delivery to the fourteenth lighting segment. Method 600 proceeds to 654.

At 650, method 600 activates the fifth lighting segment via commanding output of comparator 412 off. Commanding the comparator off allows a duty cycle of a buck voltage regulator to resume, thereby providing power delivery to the fifth lighting segment. Method 600 proceeds to 652.

At 652, method 600 activates the fourteenth lighting segment via commanding output of a comparator off. Commanding the comparator off adjusts the duty cycle of a buck voltage regulator to resume, thereby providing power delivery to the fourteenth lighting segment. Method 600 returns to 634.

At 654, method 600 judges if the command voltage is greater than a six threshold voltage. Thus, the six threshold voltage may be 8.57 volts. If method 600 judges that the command voltage is greater than 8.57 volts, the answer is yes and method 600 proceeds to 656. Otherwise, the answer is no and method 600 proceeds to 660.

At 656, method 600 deactivates a sixth lighting segment via commanding output of comparator 410 on. Commanding the comparator on adjusts the duty cycle of a buck voltage regulator to zero duty cycle, thereby ceasing power delivery to the sixth lighting segment. Method 600 proceeds to 658.

At 658, method 600 deactivates a thirteenth lighting segment via commanding output of a comparator on. Commanding the comparator on adjusts the duty cycle of a buck voltage regulator to zero duty cycle, thereby ceasing power delivery to the thirteenth lighting segment. Method 600 proceeds to exit.

At 660, method 600 activates the third lighting segment via commanding output of comparator 410 off. Commanding the comparator off allows a duty cycle of a buck voltage regulator to resume, thereby providing power delivery to the sixth lighting segment. Method 600 proceeds to 662.

At 662, method 600 activates the thirteenth lighting segment via commanding output of a comparator off. Commanding the comparator off adjusts the duty cycle of a buck voltage regulator to resume, thereby providing power delivery to the thirteenth lighting segment. Method 600 returns to 644.

In this way, lighting segments of a lighting array may be selectively activated and deactivated responsive to a command voltage. Further, method 600 deactivates or reactivates two lighting segments on opposite ends of a lighting array responsive to a command voltage exceeding or being less than a threshold voltage.

Thus, method 600 provides for a method for operating lighting segments of a lighting array, comprising: receiving a command voltage to a plurality of comparator circuits of lighting segment activation and deactivation circuitry; comparing the command voltage to a plurality of voltage levels via the plurality of comparator circuits; and deactivating one or more lighting segments in response to the command voltage exceeding one or more of the plurality of voltage levels. The method includes where the one or more lighting segments are deactivated via reducing a duty cycle of a signal to zero. The method includes where the signal is applied to a buck voltage regulator. The method further comprises adjusting logical voltage levels of lighting segment direction control logic responsive to a position of a circuit board in an enclosure. The method further comprises reducing a buffered value of the command voltage to zero volts at a second of three circuit boards in response to the second of the three circuit boards being a center circuit board. The method includes where the buffered value of the command voltage is reduced to zero via selectively coupling output of an amplifier to ground via two resistors.

As will be appreciated by one of ordinary skill in the art, the method described herein may be performed in conjunction with the circuitry described herein. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular circuitry being used.

This concludes the description. The reading of it by those skilled in the art would bring to mind many alterations and modifications without departing from the spirit and the scope of the description. For example, lighting sources producing different wavelengths of light may take advantage of the present description.

The invention claimed is:

1. A lighting system, comprising:

a plurality of lighting segment driver circuits, each of the plurality of lighting segment driver circuits electrically coupled to a lighting segment;

a plurality of circuit boards including the plurality of lighting segment driver circuits, each circuit board of the plurality of circuit boards is identical to other circuit boards of the plurality of circuit boards, each of the plurality circuit boards including a plurality of comparator circuits that is in electrical communication with the plurality of lighting segment driver circuits, inputs of the plurality of comparator circuits in electrical communication with a plurality of resistors that is electrically coupled in series, an output of a first lighting segment deactivation direction control comparator circuit in electrical communication with a first resistor in the plurality of resistors that is electrically coupled in series, an output of a second lighting segment deactivation direction control comparator circuit in electrical communication with a second resistor in the plurality of resistors that is electrically coupled in series; and lighting segment direction control logic on each of the plurality of circuit boards, wherein the lighting segment direction control logic includes a voltage divider electrically coupled to a plus input of the first lighting segment deactivation direction control comparator circuit and to a minus input of the second lighting segment deactivation direction control comparator circuit, the lighting segment direction control logic provides a voltage level that causes a first comparator to output a first voltage and a second comparator to output a second voltage, wherein the first voltage is greater than the second voltage.

2. The lighting system of claim 1, wherein the plurality of lighting segments is an actual total number of lighting segments, wherein the plurality of circuit boards is an actual total number of circuit boards, and wherein the actual total number of lighting segments divided by the actual total number of circuit boards is an integer.

3. The lighting system of claim 1, wherein the plurality of circuit boards is an actual total of three circuits boards, and wherein a second of the three circuit boards does not selectively deactivate any of the plurality of lighting segment driver circuits in response to a lighting segment deactivation command voltage.

4. The lighting system of claim 3, wherein a first and a third of the three circuit boards selectively deactivate one or more of the plurality of lighting segment driver circuits in response to the lighting segment deactivation command voltage, wherein the lighting segment deactivation command voltage is provided via a potentiometer.

5. The lighting system of claim 1, wherein a lighting intensity command voltage is provided via a potentiometer to the plurality of circuit boards, wherein the first lighting segment deactivation direction control comparator circuit is directly electrically coupled to the first resistor, wherein the second lighting segment deactivation direction control comparator circuit is directly electrically coupled to the second resistor, wherein the plus input of the first lighting segment deactivation direction control comparator circuit is directly electrically coupled to the minus input of the second lighting segment deactivation direction control comparator circuit, wherein a minus input of the first lighting segment deactivation direction control comparator circuit is directly electrically coupled to a plus input of the second lighting segment deactivation direction control comparator circuit, and wherein at least one resistor is electrically coupled in series between the first resistor and the second resistor.

6. A lighting system, comprising:

a plurality of lighting segment driver circuits, each of the plurality of lighting segment driver circuits electrically coupled to a lighting segment, the plurality of lighting segment driver circuits included on a single circuit board; and lighting segment activation and deactivation circuitry electrically coupled to the plurality of lighting segment driver circuits, the lighting segment activation and deactivation circuitry including a plurality of voltage sensing comparator circuits, each of the plurality of voltage sensing comparator circuits electrically coupled to one of the plurality of lighting segment driver circuits, the lighting segment activation and deactivation circuitry included on at least a first circuit board and a second circuit board, the lighting segment activation and deactivation circuitry including a first transistor that is electrically coupled to a first diode and a second transistor that is electrically coupled to a second diode, the first diode electrically coupled to the second diode, and the first diode and the second diode electrically coupled to a third transistor that enables or disables deactivation of the plurality of lighting segment driver circuits.

7. The lighting system of claim 6, further comprising a plurality of resistors electrically coupling an output of a first lighting segment activation direction control comparator and an output of a second lighting segment activation direction control comparator.

8. The lighting system of claim 7, wherein the plurality of resistors is electrically coupled to the plurality of voltage sensing comparator circuits.

9. The lighting system of claim 8, wherein the plurality of voltage sensing comparator circuits is further electrically coupled to a command voltage.

10. The lighting system of claim 9, wherein the command voltage is provided via a potentiometer.

11. The lighting system of claim 6, wherein each of the plurality of lighting segment driver circuits includes a buck voltage regulator and a transistor to deactivate the buck voltage regulator.

12. The lighting system of claim 11, wherein only one of the plurality of voltage sensing comparator circuits is directly electrically coupled to the transistor.

13. A method for operating lighting segments of a lighting array, comprising:

receiving a command voltage at a plurality of comparator circuits of lighting segment activation and deactivation circuitry located on a circuit board;

comparing the command voltage to a plurality of voltage levels via the plurality of comparator circuits of the lighting segment activation and deactivation circuitry located on the circuit board;

deactivating one or more lighting segments electrically coupled to the circuit board in response to the command voltage exceeding one or more of the plurality of voltage levels; and adjusting logical voltage levels of the lighting segment activation and deactivation circuitry located on the circuit board responsive to a position of the circuit board in an enclosure.

14. The method of claim 13, wherein the one or more lighting segments are deactivated via reducing a duty cycle of a signal to zero.

15. The method of claim 14, wherein the signal is applied to a buck voltage regulator.

16. The method of claim 13, further comprising adjusting a logical level input to two comparator circuits to enable deactivation of the one or more lighting segments in a first direction, and adjusting the logical level input to the two comparator circuits to enable deactivation of the one or more lighting segments in a second direction, wherein the first direction is opposite of the second direction.

17. The method of claim 13, further comprising reducing a buffered value of the command voltage to zero volts when the circuit board is a second of three circuit boards, the second circuit board being a center circuit board of the three circuit boards.

18. The method of claim 17, wherein the buffered value of the command voltage is reduced to zero volts via selectively coupling an output of an amplifier to ground via two resistors.

* * * * *